US006045399A

United States Patent [19]

Yu

[11] Patent Number: 6,045,399

[45] Date of Patent: Apr. 4, 2000

[54] COMBINATION OUTLET STRIP

[76] Inventor: Tsung-I Yu, No. 45, Sec. 3, Ba Der Rd., Ban Chyau City, Taipei Hsien, Taiwan

[21] Appl. No.: 09/195,248

[22] Filed: Nov. 18, 1998

[51] Int. Cl.[7] ..... H01R 11/00

[52] U.S. Cl. ..... 439/502; 439/214; 439/646; 439/650

[58] Field of Search ..... 439/502, 212, 439/213, 214, 107, 646, 647, 652, 654, 686, 687, 949

[56] References Cited

U.S. PATENT DOCUMENTS

| | | | |
|---|---|---|---|
| 4,867,701 | 9/1989 | Wiand | 439/501 |
| 5,071,367 | 12/1991 | Luu | 439/501 |
| 5,232,381 | 8/1993 | Yu | 439/652 |
| 5,334,033 | 8/1994 | Milan | 439/214 |
| 5,780,775 | 7/1998 | Yu | 174/135 |
| 5,967,815 | 10/1999 | Schlessinger et al. | 439/188 |

*Primary Examiner*—Michael L. Gellner
*Assistant Examiner*—Richard K. Lee
*Attorney, Agent, or Firm*—Bacon & Thomas

[57] ABSTRACT

A combination outlet strip includes a casing and a plurality of outlet strip units connected in series and mounted in the casing, each outlet strip unit having a bottom shell, a top shell covered on the bottom shell, and three bus bars mounted in between the bottom shell and the top shell, the bus bars each having a coupling hole and a stud at two opposite ends outside the top and bottom shells, and a plurality of clamping strips for receiving the blades/grounding prongs of electric plugs, the outlet strip units being connected in series by fastening the studs of the bus bars of one outlet strip unit to the coupling holes of the bus bars of another outlet strip unit.

2 Claims, 5 Drawing Sheets

COMBINATION OUTLET STRIP

BACKGROUND OF THE INVENTION (a) Field of the Invention

The present invention relates to an outlet strip, and more particularly to a combination outlet strip which comprises a casing, and a plurality of outlet strip units connected in series and mounted in the casing. The insertion slots of the receptacles of the outlet strip units are extended in direction at 90° angle relative to the longitudinally extended bus bars of the outlet strip units.

(b) Description of the Prior Art

In conventional outlet strip assemblies, conductors are used to connect electrical elements, so as to establish a complete electrical connection. This design complicates the assembly procedure. Further, the connecting areas between the conductors and the electrical elements tend to be damaged by heat. U.S. Pat. No. 4,979,907 discloses an outlet strip assembly, which comprises a multiple receptacle mechanism, that receives three bus bars to establish a complete electrical connection for electrical plugs and power lines. The length of the bus bars is determined subject to the size of the multiple receptacle mechanism, i.e., different lengths of bus bars must be used with different sizes of multiple receptacle mechanism for making different sizes of outlet strip assemblies. Furthermore because the insertion slots of the receptacles of a conventional outlet strip assembly are extended in longitudinal direction, the installation of an AC adapter 10 in one receptacle causes an adjacent receptacle to be hindered by the cable 101 of the AC adapter 10 (see FIG. 7).

SUMMARY OF THE INVENTION

According to one aspect of the present invention, the combination outlet strip comprises a casing and a plurality of outlet strip units connected in series and mounted in the casing, wherein each outlet strip unit comprises a bottom shell, a top shell covered on the bottom shell, and three bus bars mounted in between the bottom shell and the top shell, the bus bars each having a coupling hole and a stud at two opposite ends outside the top and bottom shells, and a plurality of clamping strips for receiving the blades/grounding prongs of electric plugs, the outlet strip units being connected in series by fastening the studs of the bus bars of one outlet strip unit to the coupling holes of the bus bars of another outlet strip unit. According to another aspect of the present invention, the receptacles of the outlet strip units each have two blade insertion slots and one grounding prong insertion slot extended in direction at 90° angle relative to the longitudinally extended bus bars such that the cable of one electric plug installed in one receptacle does not hinder the installation of other electric plugs in the other receptacles.

DETAILED DESCRIPTION OF THE PREFERRED EMBODIMENT

Figure 1:
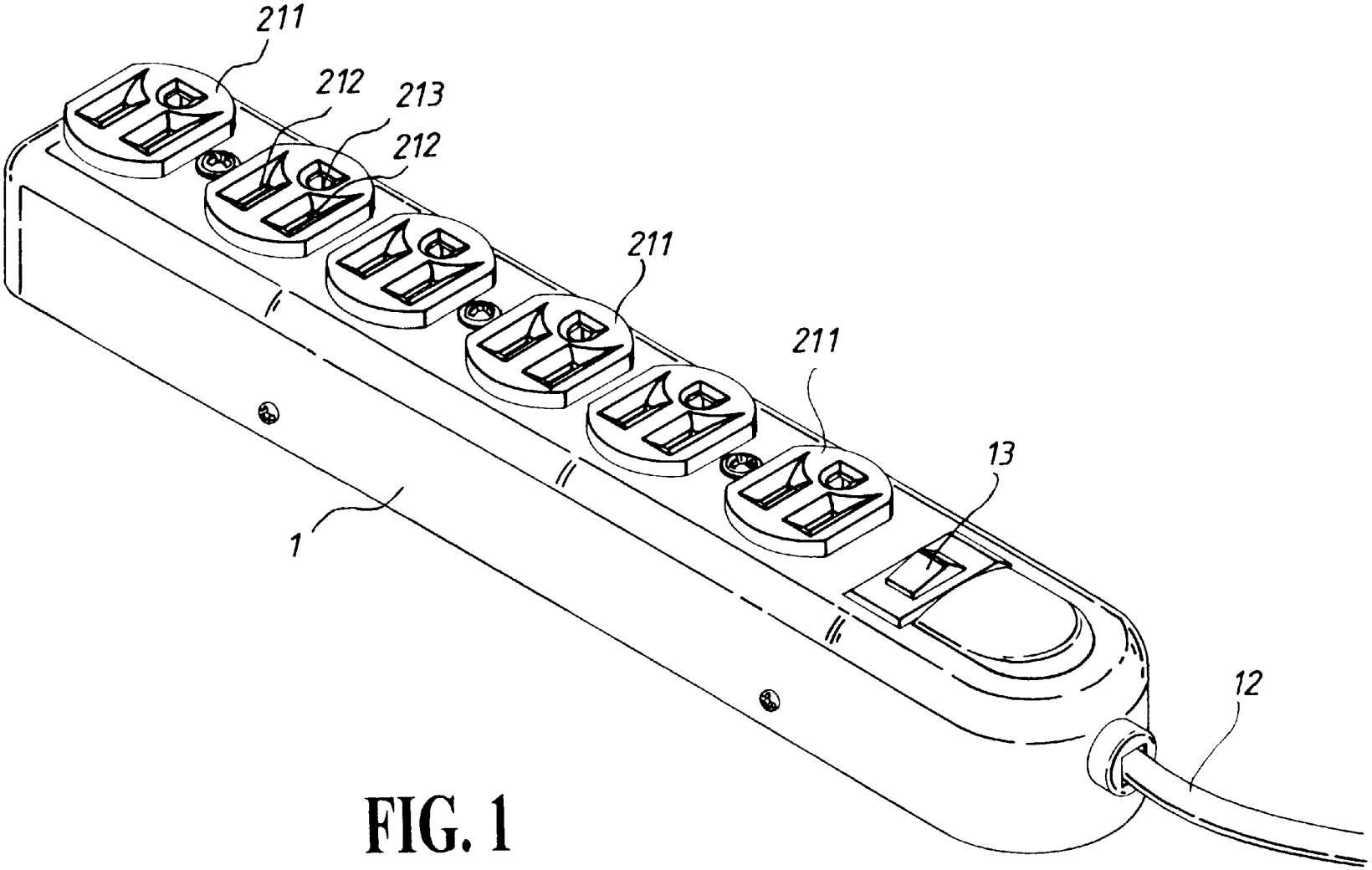
FIG. 1 is a perspective view of a combination outlet strip according to the present invention.
Figure 2:
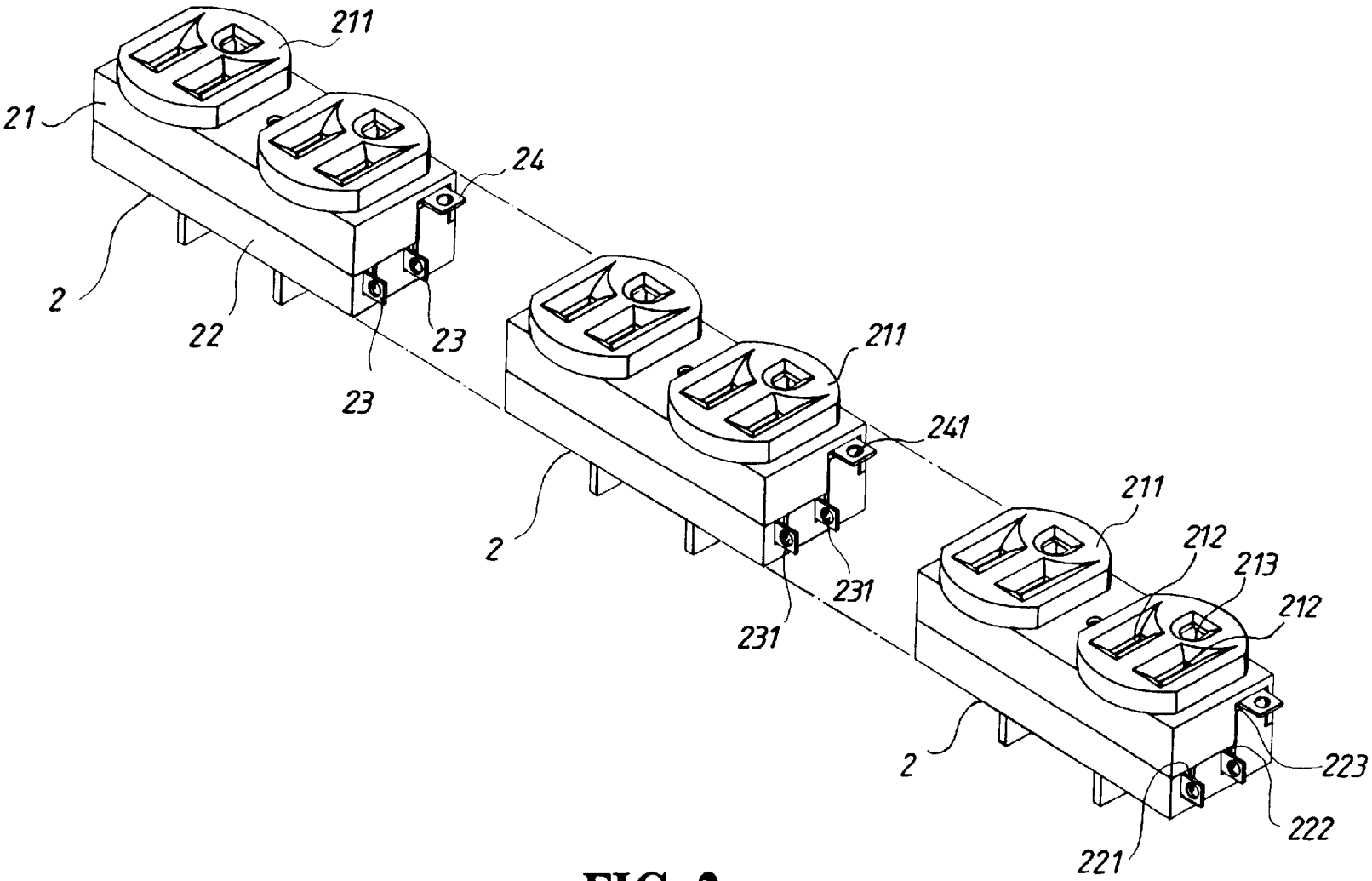
FIG. 2 is an exploded view of the outlet strip units according to the present invention.
Figure 3:
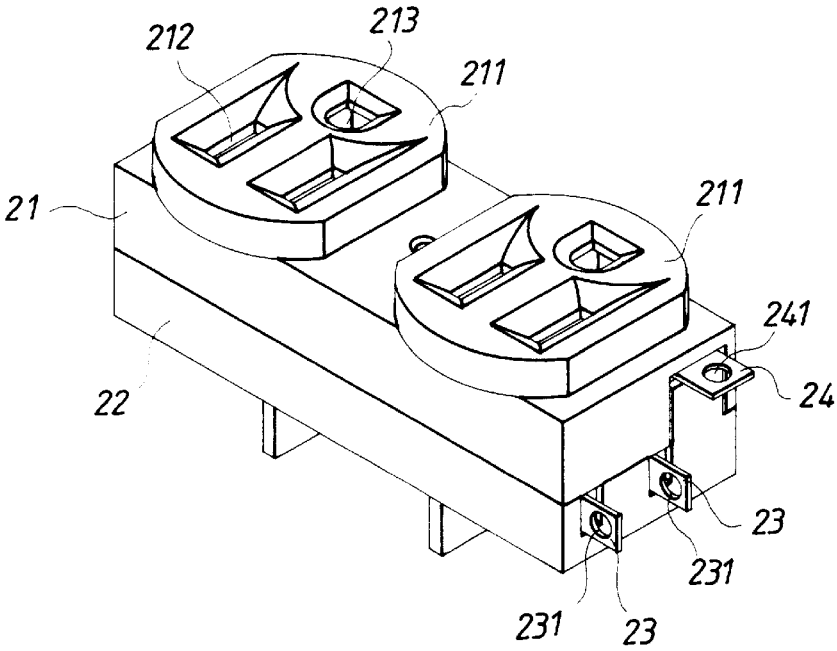
FIG. 3 is an elevational view of an individual outlet strip unit according to the present invention.
Figure 4:
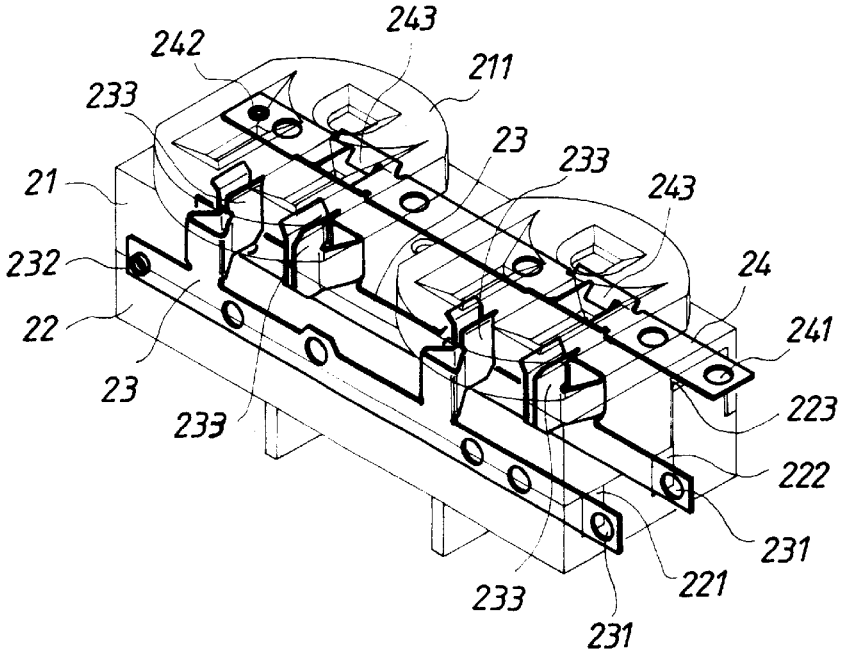
FIG. 4 is a perspective of the individual outlet strip unit shown in FIG. 3, showing the positioning of the bus bars in the shells.

Referring to FIGS. from 1 through 4, a combination outlet strip in accordance with the present invention is generally comprised of a casing 1, and a plurality of outlet strip units 2 connected in series and mounted in the casing 1.

The casing 1 has a bottom side covered with a bottom cover 11, which holds the outlet strip units 2 in the casing 1, a plurality of holes (not shown) at the top, which receive the receptacles 211 of the outlet strip units 2, a power cable 12 at one end, and an on/off switch 13 for power on/off control.

The outlet strip units 2 each are comprised of a bottom shell 22, an upper shell 21 covered on said bottom shell 22, and three bus bars 23 and 24 mounted in between the upper shell 21 and the bottom shell 22. The upper shell 21 comprises multi-apertured receptacles 211. The bottom shell 22 comprises three channels 221, 222 and 223, which receive the three bus bars 23 and 24. Two channels 221 and 222 are longitudinally disposed in parallel at a lower elevation within the bottom shell 22. The other channel 223 is longitudinally disposed in the bottom shell 22 at a higher elevation. The bus bars 23 and 24 include two power bus bars 23 for connection to the positive and negative terminal of power supply, and one bus bar 24 for grounding. The power bus bars 23 each have a coupling hole 231 at one end, a stud 232 at an opposite end, and a plurality of clamping strips 233 longitudinally spaced at a top side. The stud 232 is formed of a part of the respective bus bar 23 by stamping. The coupling holes 231 and studs 232 of the power bus bars 23 are respectively disposed outside the front and rear ends of the corresponding outlet strip unit 2. The bus bars 23 are respectively mounted in the channels 221 and 222. When installed, the clamping strips 233 of the bus bars 23 are set in pairs corresponding to the receptacles 211 of the respective outlet strip unit 2 for receiving the blades of electric plugs. The grounding bus bar 24 comprises a coupling hole 241 at one end, a stud 242 at an opposite end, and a plurality of clamping strips 243 longitudinally spaced at one side corresponding to the receptacles 211 of the respective outlet strip unit 2 for receiving the grounding prongs of electric plugs. The coupling hole 241 and stud 242 of the grounding bus bar 24 are respectively disposed outside the front and rear ends of the corresponding outlet strip unit 2.

Figure 5:
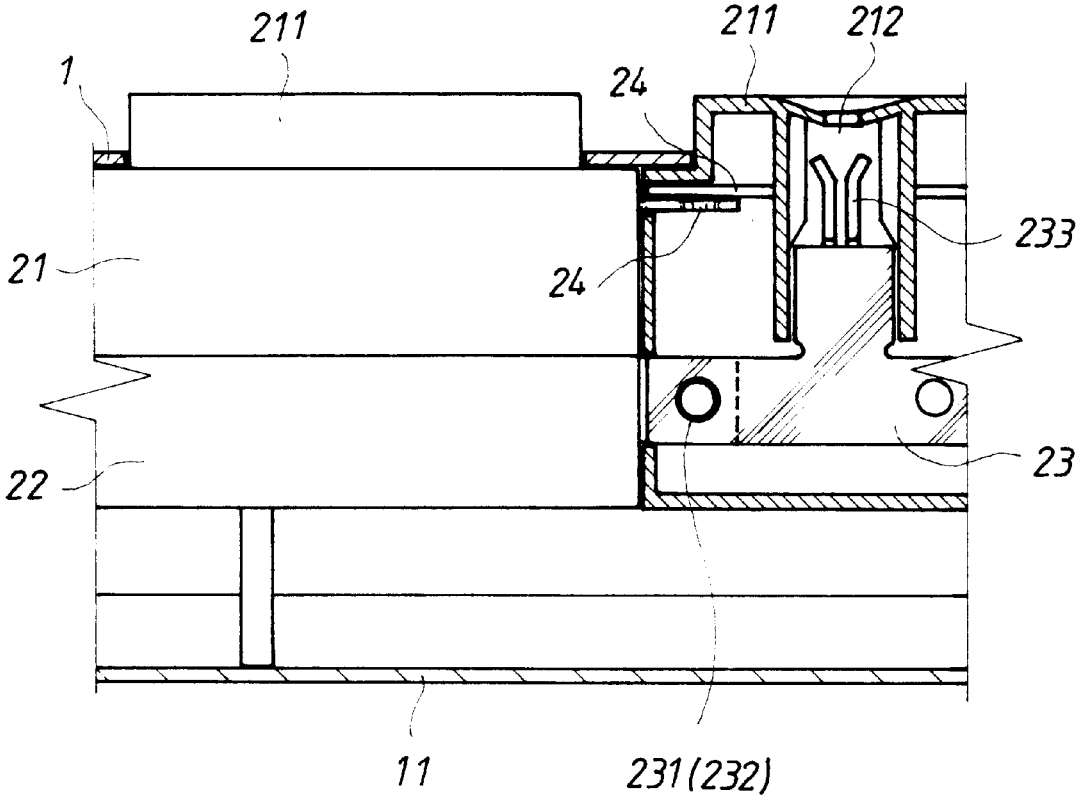
FIG. 5 is a sectional view in an enlarged scale of a part of the present invention, showing the connection between two outlet strip units.
Figure 7:
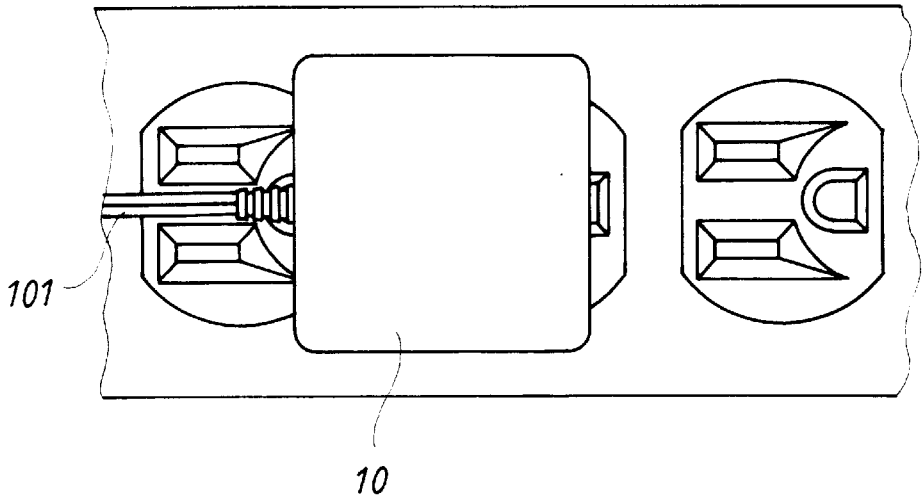
FIG. 7 illustrates the installation of an AC adapter in an outlet strip assembly according to the prior art.

Referring to FIG. 5 and FIGS. from 1 through 4 again, the coupling the studs 232 and 242 of the three bus bars 23 and 24 of one outlet strip unit 2 to the coupling holes 231 and 241 of the three bus bars 23 and 24 of another outlet strip unit 2, a plurality of outlet strip units 2 arc connected in series. The connected outlet strip units 2 are then fastened to the bottom cover 11, and then the bottom cover 11 is covered on the casing 1 to hold the connected outlet strip units 2 in the casing 1.

Figure 6:
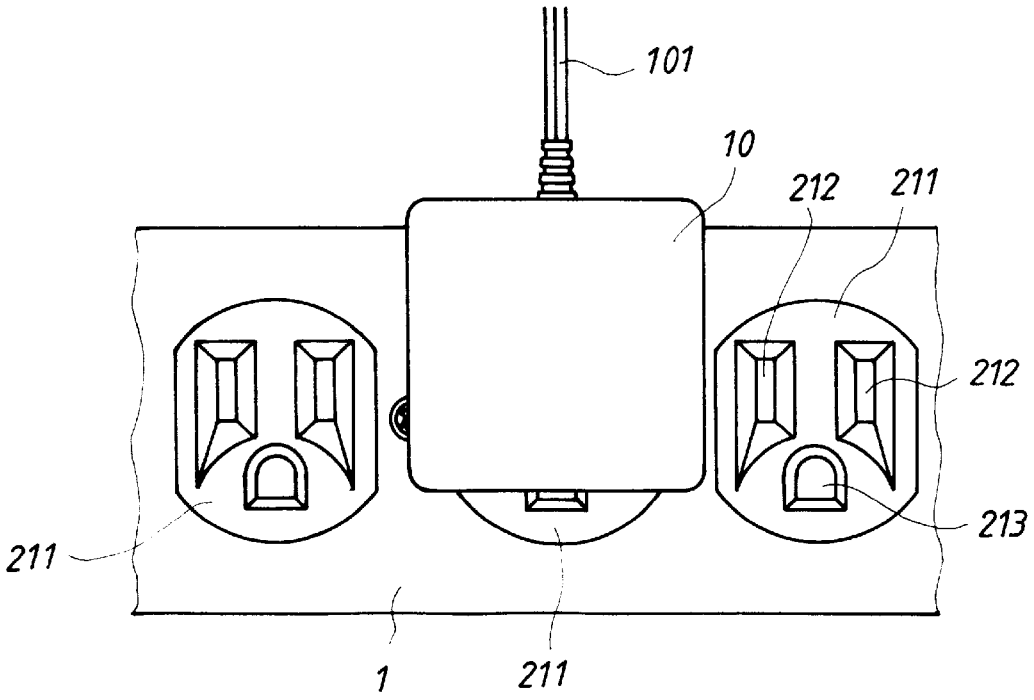
FIG. 6 is an applied view of the present invention, showing an AC adapter installed in one receptacle of the combination outlet strip.

Referring to FIG. 6, the receptacles 211 of the outlet strip units 2 each comprise two blade insertion slots 212 and one grounding prong insertion slot 213 for receiving the blades and grounding prong of an AC adapter 10 or electric plug (not shown). The blade insertion slots 212 and 213 are extended in direction at 90° relative to the longitudinally extended direction of bus bars 23 and 24. When an AC adapter 10 is installed in one receptacle 211, the cable 101 of the AC adapter 10 is maintained beyond the outlet strip units 2 in the casing 1 without hindering the insertion of electric plugs in the other receptacles 211.

What the invention claimed is:

1. A combination outlet strip comprising a casing having an on/off switch and a cable connected to said on/off switch, and a plurality of outlet strip units connected in series and mounted in said casing, wherein said outlet strip units each comprise:

a bottom shell, said bottom shell comprising two first channels longitudinally arranged in parallel at a lower side, and a second channel longitudinally disposed at an upper side;

an upper shell covered on said bottom shell, said upper shell comprising a plurality of multi-apertured receptacles for receiving electric plugs;

two power bus bars respectively mounted in the first channels on said bottom shell, said power bus bars each comprising a coupling hole at one end disposed outside said bottom shell, a stud at an opposite end disposed outside said bottom shell, and a plurality of clamping strips longitudinally spaced at a top side, the clamping strips of said power bus bars being arranged in parallel corresponding to the receptacles at said upper shell for receiving the blades of electric plug means; and a grounding bus bar mounted in the second channel of said bottom shell, said grounding bus bar comprising a coupling hole at one end disposed outside said bottom shell, a stud at an opposite end disposed outside said bottom shell, and a plurality of clamping strips longitudinally spaced at one side corresponding to the receptacles at said upper shell for receiving the grounding prongs of electric plugs;

said outlet strip units are connected in series by fastening the studs of the power bus bars and grounding bus bar of one outlet strip unit to the coupling holes of the power bus bars and grounding bus bar of another outlet strip unit.

2. The combination outlet strip of claim 1 wherein the receptacles of said outlet strip units each have two blade insertion slots and one grounding prong insertion slot extended in direction at 90° angle relative to said power and grounding bus bars.

* * * * *